United States Patent [19]

Carlson et al.

[11] Patent Number: 4,586,562

[45] Date of Patent: May 6, 1986

[54] PLATE AND FRAME HEAT EXCHANGER ASSEMBLY WITH ANODIC PROTECTION

[75] Inventors: Richard C. Carlson, Euclid; Donald L. DeRespiris, Mentor; Anthony R. Sacco, Chardon, all of Ohio; Donald J. Groszek; Bonnie M. Ivancic, both of Florence, Ala.

[73] Assignee: Eltech Systems Corporation, Boca Raton, Fla.

[21] Appl. No.: 521,944

[22] Filed: Aug. 10, 1983

[51] Int. Cl.[4] ..... F28F 19/02; F28F 3/08; C23F 13/00

[52] U.S. Cl. ..... 165/134.1; 165/167; 204/147; 204/196

[58] Field of Search ..... 165/134 R, 166, 167; 204/147, 196; 210/748

[56] References Cited

U.S. PATENT DOCUMENTS

| | | | |
|---|---|---|---|
| 1,020,480 | 3/1912 | Cumberland | 165/134 R |
| 1,365,141 | 1/1921 | Adam | 204/147 |
| 3,312,054 | 4/1967 | Anderson . | |
| 3,520,790 | 7/1970 | Araki et al. | 204/196 |
| 3,783,090 | 1/1974 | Andersson . | |
| 3,951,207 | 4/1976 | Baumann et al. | 165/134 R |
| 3,984,302 | 10/1976 | Freedman et al. | 204/147 |
| 4,139,054 | 2/1979 | Anderson . | |
| 4,201,263 | 5/1980 | Anderson . | |
| 4,256,556 | 3/1981 | Bennett et al. | 204/147 |
| 4,345,981 | 8/1982 | Bennett et al. | 204/147 |

FOREIGN PATENT DOCUMENTS

| | | | |
|---|---|---|---|
| 1306937 | 9/1962 | France | 165/134 R |
| 0197708 | 8/1977 | U.S.S.R. | 165/134 R |

*Primary Examiner*—William R. Cline
*Assistant Examiner*—John K. Ford
*Attorney, Agent, or Firm*—John J. Freer

[57] ABSTRACT

A plate heat exchanger assembly is provided having an anodic protection system comprising a plate heat exchanger frame, a plurality of heat exchanger plates mounted to the frame and means for selectively applying a voltage across the plates whereby during operation of the plate heat exchanger assembly biofouling and scaling is inhibited. The plurality of heat exchanger plates are mounted to the frame to define a plurality of heat exchange chambers for heat communication between a first and second process fluid being transmitted through the assembly. An insulating contact coating at points of electrically conductive contact between adjacent plates of the heat exchange chambers is provided such that the chambers comprise electrolytic chambers means are provided for selectively applying a voltage across said adjacent plates. A method of applying the insulating contact coating to a heat exchanger plate is also disclosed. The method comprises identifying points of electrically conductive contact between said adjacent heat exchanger plates and applying an insulating material to the points of contact.

10 Claims, 9 Drawing Figures

FIG. 1
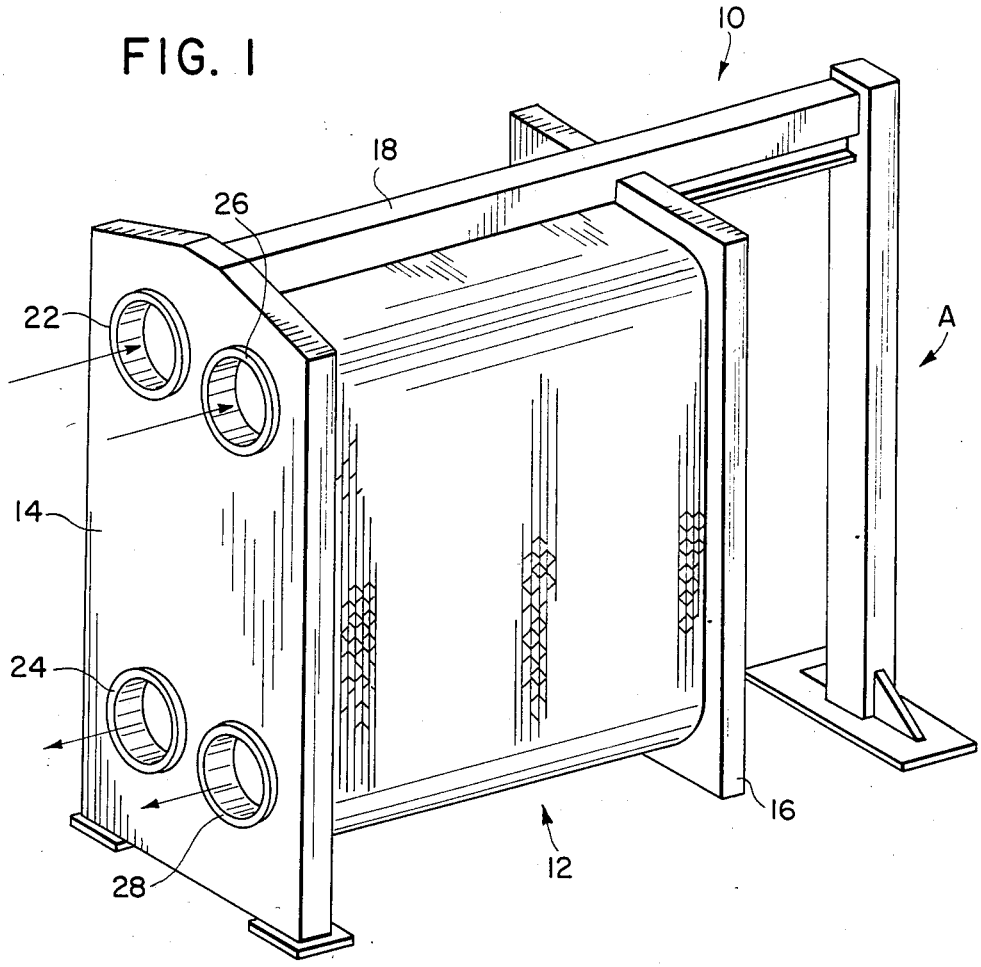
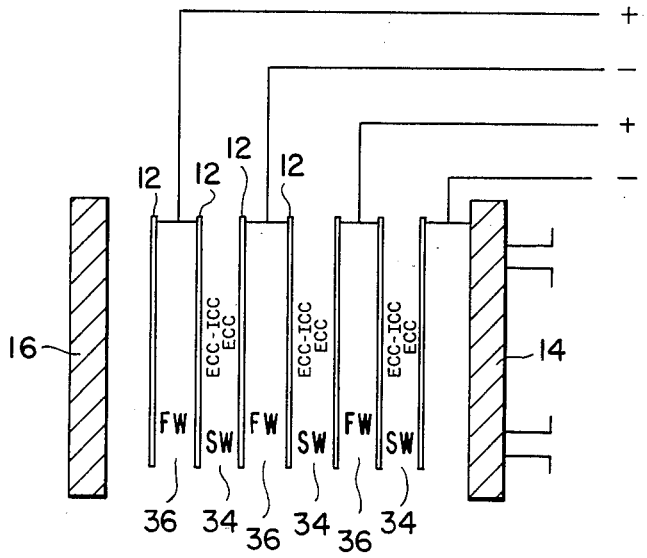
FIG. 2

PLATE AND FRAME HEAT EXCHANGER ASSEMBLY WITH ANODIC PROTECTION

BACKGROUND OF THE INVENTION

This invention pertains to the art of heat exchanging devices and more particularly to heat exchanging devices comprising a plurality of assembled heat exchanger plates.

The invention is particularly applicable to a plate and frame heat exchanger assembly that employs sea water as a heat exchange fluid in the assembly. However, it will be appreciated by those skilled in the art that the invention could be readily adapted for use with other types of fluids as, for example, where similar heat exchanger assemblies are employed with plate-fouling fluids in the course of operation.

A great portion of conventional heat exchanger assemblies use sea water as a cooling fluid in the heat exchanger operation. As sea water is comprised of many elemental and organic items, such assemblies suffer the problems of deposits forming on heat exchange surfaces which affect heat transfer operation. Where the deposits are primarily organic the build-up is referred to as biofouling. Chemical deposits are generally referred to as scale. As biofouling and scale deposits build up on a heat exchanger surface, the heat exchanger operational efficiency diminishes to the point where it becomes necessary to either chemically or mechanically remove the deposits from the heat exchange surfaces. The problems of biofouling and scale deposit are so prevalent that it is a common industry practice to intentionally over-design heat exchanger capacities to allow for the diminishing efficiency resulting from such deposits.

An improved method for controlling biofouling and scale is disclosed in U.S. Pat. Nos. 4,256,556 and 4,345,981 which disclose a method of anodically polarizing surfaces to define an electrolytic chamber for sea water in order to effect biofouling and scale control. However, problems have arisen in the attempts to apply the method of these patents to conventional plate heat exchanger constructions. More particularly, most conventional plate heat exchanger assemblies include opposed heat exchange plates which are in electrically conductive contact and which, therefore, are unsuitable for anodic polarization.

In a plate heat exchanger, the plates are typically constructed of titanium and are designed to be as thin as possible in their cross-sectional dimension to maximize heat exchange efficiency. Such plates are very flexible and when assembled and compressed in a plate heat exchanger frame, are frequently deformed into abutting contact. Attempts to maintain a separation of the plates to define an electrolytic chamber by mere spacing of the plates with perimeter sealing gaskets have been largely unsuccessful due to the pliancy of the plates and, more importantly, because of the operational desirability of maintaining the plates in as close a contact as possible. Coating of an entire plate surface with an insulator material to avoid electrically conductive contact between the plates has also proved undesirable in that the coating over the plate acts itself as a surface deposit which diminishes heat exchange efficiency. Although such electrically insulated plates could likely employ the method of the aforementioned patents, the heat exchanger operation of such a construction would be unacceptable.

The present invention contemplates a new and improved device which overcomes all of the above problems and others to provide a new plate heat exchanger assembly which is simple in design, economical to manufacture, readily adaptable to a plurality of heat exchanger plate configurations having a variety of dimensional characteristics, easy to apply and which provides improved plate heat exchanger assembly operation.

BRIEF SUMMARY OF THE INVENTION

In accordance with the present invention, there is provided a plate heat exchanger comprising at least a pair of heat exchanger plates. The plates are electrically isolated with an insulating contact coating to define an electrolytic chamber therebetween. The insulating contact coating is disposed at locations of potential abutting contact between the pair on at least one of the pair. A means is provided for selectively applying a voltage between the pair whereby the plate heat exchanger may be anodically polarized for biofouling and scale control in heat exchange operation.

In accordance with another aspect of the present invention, a method of applying an insulating contact coating to a heat exchanger plate is disclosed. The method comprises identifying points of electrically conductive contact between one heat exchanger plate and an adjacent plate and applying an insulating material to the points of contact whereby upon compression fitting of a plurality of the plates, adjacent plates are electrically insulated to define an electrolytic chamber therebetween.

In accordance with yet another aspect of the present invention, the method of applying the insulating contact coating comprises masking a heat exchanger plate with a mask including mask apertures at the points of electrically conductive contact. Applying the insulating contact coating comprises coating the mask with the insulating contact coating for selective application of the coating to the plates through said apertures, i.e. at the points of electrically conductive contact only. The electrically nonconductive coating preferably comprises an epoxy amide resin including alumina.

In accordance with the present invention there is also provided a plate heat exchanger assembly having an anodic protection system comprising a plate heat exchanger frame, a plurality of heat exchanger plates mounted to the frame, and means for selectively applying a voltage across adjacent plates whereby during operation of the plate heat exchanger assembly biofouling and scaling is inhibited. The plate heat exchanger frame has a first inlet and a first outlet for a first process fluid and a second inlet and a second outlet for a second process fluid. The plurality of heat exchanger plates mounted to the frame define a plurality of heat exchange chambers for heat communication between the first process fluid and the second process fluid. The plurality of chambers comprise fluid passageways for selectively communicating the first process fluid from the first inlet to the first outlet and for selectively communicating the second process fluid from the second inlet to the second outlet. The passageways comprise a plurality of first passageways for the first process fluid and a plurality of second passageways for the second process fluid in alternating sequence with each other. An insulating contact coating at potential points of electrically conductive contact between adjacent plates forming said first passageways is provided such that the first passageways comprise electrolytic chambers when means for selectively applying a voltage is provided across the adjacent plates of the first passageways.

In accordance with yet another aspect of the present invention, the adjacent plates forming said first passageways further include plate surfaces having an electrocatalytic coating for catalyzing oxygen evolution.

One benefit obtained by use of the present invention is a plate heat exchanger assembly that inhibits biofouling and scale deposits in a marine environment to allow continuous operation of the assembly without the need for periodic shutdown and cleaning.

A further benefit of the present invention is a method of applying an insulating contact coating to a heat exchanger plate wherein the insulating coating is applied only at points of electrically conductive contact between one heat exchanger plate and an adjacent plate such that heat exchange operational efficiency is not diminished by excessive application of insulating contact coating.

Other benefits and advantages for the subject new plate heat exchanger assembly will become apparent to those skilled in the art upon a reading and understanding of this specification.

BRIEF DESCRIPTION OF THE DRAWINGS

The invention may take physical form in certain parts and arrangements of parts, the preferred embodiment of which will be described in detail in this specification and illustrated in the accompanying drawings which form a part hereof and wherein:

FIG. 1 is a perspective view of a plate heat exchanger assembly formed in accordance with the present invention;

FIG. 2 is a schematic representation of a plate heat exchanger assembly formed in accordance with the present invention;

DETAILED DESCRIPTION OF THE INVENTION

Figure 3:
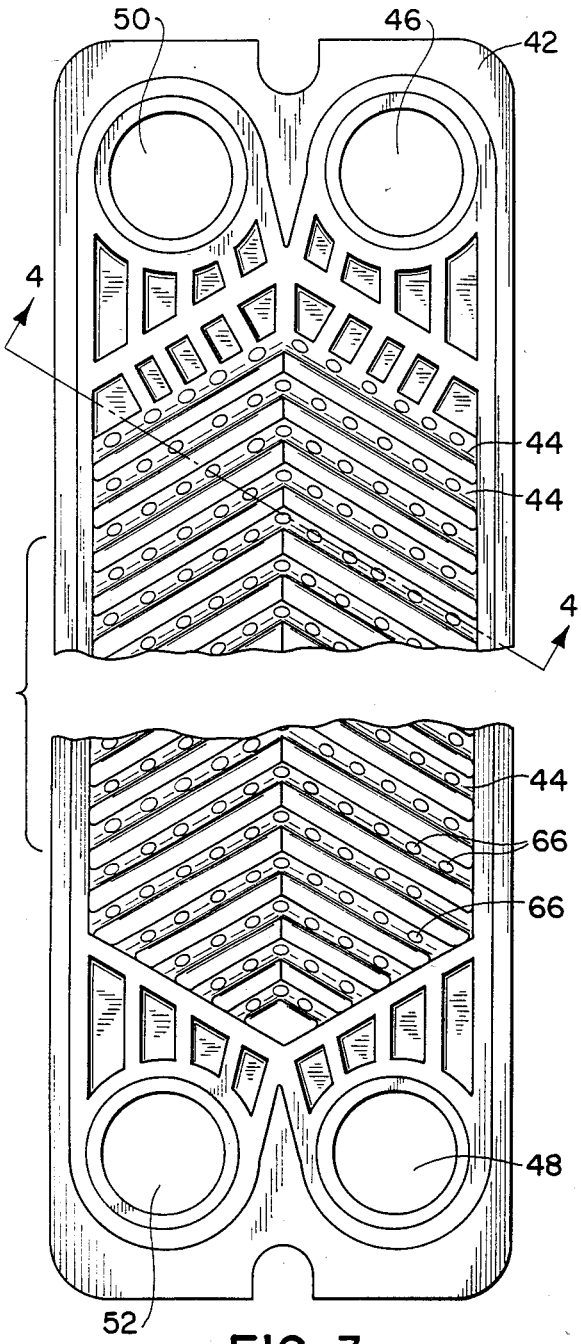
FIG. 3 is a heat exchanger plate particularly illustrating an insulating contact coating at points of potential electrically conductive contact with an adjacent plate and with a sectional cut-out for ease of illustration.

Referring now to the drawings which are for purposes of illustrating the preferred embodiment of the invention only and not for purposes of limiting the invention, the figures show a plate heat exchanger assembly A particularly adapted for heat exchange operation between two process fluids. The assembly A includes a plate heat exchanger frame 10 for receiving and mounting a plurality of heat exchanger plates 12. The frame includes a stationary end plate 14 and a selectively adjustable pressure plate 16 for sealingly compressing the plurality of plates 12. Both the plates 12 and the adjustable plate 16 are aligned with a keyed transverse beam 18 to which a preselected number of plates 12 may be mounted for use in the assembly A. The plates 12 may be kept in sealing engagement between the end plate 14 and the adjustable plate 16 with any conventional compression locking means such as a plurality of tie bars or an adjustable toggle (not shown). In the stationary end plate 14 of the frame 10 a first inlet 22 and a first outlet 24 are included for a first process fluid and a second inlet 26 and a second outlet 28 are provided for communication of a second process fluid through the plurality of heat exchanger plates 12. The frame 10 illustrated in FIG. 1 is merely illustrative of one particular frame assembly, and it will be appreciated by one skilled in the art that a wide variety of frames and mounting constructions are available for maintaining a plurality of heat exchanger plates in a proper sealed and assembled manner.

With particular reference to FIG. 2, a schematic diagram of a plate heat exchanger assembly having an anodic protection system in accordance with the present invention is illustrated. The invention employs the methods of anodically polarized surfaces for biofouling and scale control disclosed in U.S. Pat. Nos. 4,256,556 and 4,345,981. For ease of illustration, the invention is described with respect to heat exchangers using sea water and fresh water as the process fluids. Accordingly, alternate heat exchange chambers comprising fluid passageways for sea water (SW) as a first process fluid and fresh water (FW) as a second process fluid are provided for heat exchange between the fresh water and the sea water. As the heat exchange chambers 34 carry sea water they are particularly subject to biofouling and scale deposits. The anodic marine protection system of the aforementioned patents comprises placing an electrocatalytic coating (ECC) on opposed surfaces of the sea water passageways for catalyzing oxygen evolution. The voltage necessary to maintain the electrolytic nature of the sea water passageways 34 is applied across the adjacent heat transfer plates defining the sea water passageways 34. As heat transfer plates 12 are typically formed of titanium and desirably thin to effect the most efficient heat transfer possible, they are particularly pliant and when compressed between the stationary end plate 14 and the adjustable end plate 16 are subject to electrically conductive contact at a plurality of points in the plates 12. If the adjacent plates defining a sea water passageway 34 were to contact in an electrically conductive manner, it would be impossible to maintain a voltage across the chamber to effect the necessary electrocatalytic reaction which inhibits biofouling and scale formation. Therefore, to maintain the voltage it is necessary to apply an insulating contact coating (ICC) at locations of potential abutting contact between the pair of adjacent heat transfer plates defining the sea water passageways 34. As the fresh water passageways 36 are not subject to biofouling and scale deposit it is not necessary to maintain them as an electrolytic chamber and they are freely electrically conductive at points of abutting engagement such that the adjacent plates of a fresh water passageway 36 are maintained at the same voltage upon application of the voltage to either of the plates defining the passageway 36. By applying an opposite (i.e. oppositely polarizing the plate pairs forming) to each fresh water passageway 36 a voltage is thus maintained across each intervening sea water passageway 34. It is a particular feature of the present invention that the application and maintenance of the insulating contact coating which maintains the electrolytic chamber for each sea water passageway 34 negligably effects the heat transfer operation of the plate heat exchanger assembly while allowing the assembly to operate continuously without biofouling and scale deposit. Periodic reversal of the voltage across each sea water passageway 34 is necessary to avoid cathodic biofouling and scale deposit at the cathodic plate of each sea water electrolytic chamber 34.

It is also within the scope of the invention to electrically insulate the fresh water passageways 36 such that all fluid passageways may comprise electrolytic chambers. In such a construction all plates 12 are electrically isolated by an insulating contact coating and a preselected voltage charge can be applied to each plate in the assembly.

Figure 5:
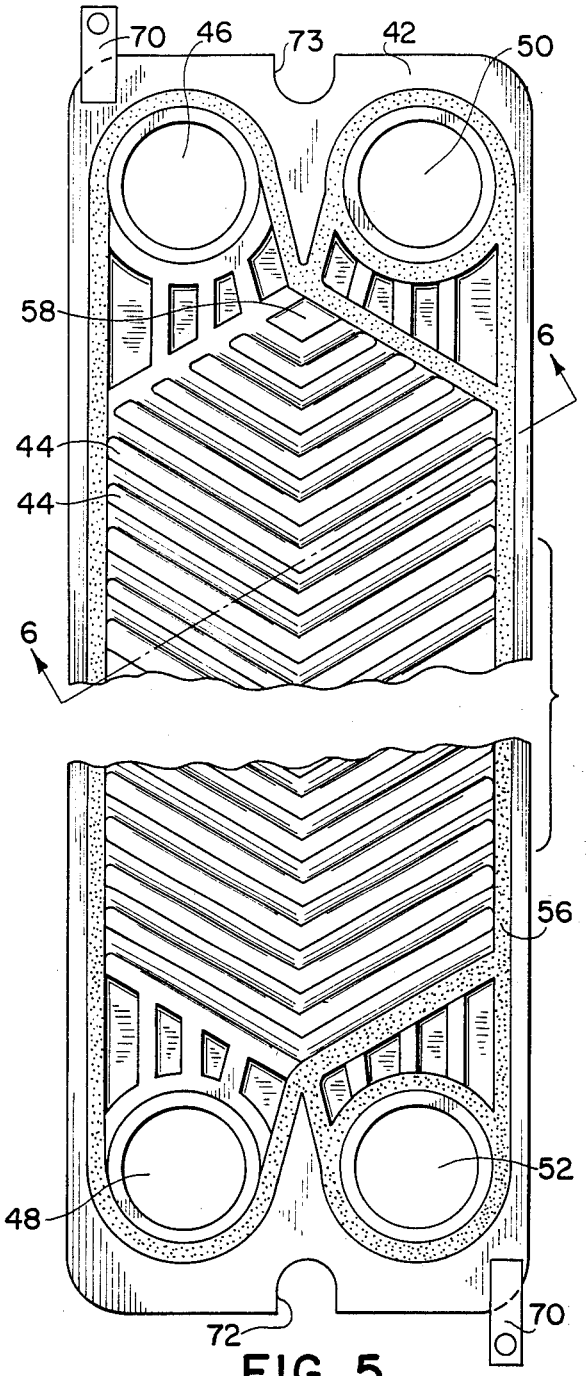
FIG. 5 is a plan view of a heat exchanger plate which is conformed for facing abutment to the heat exchanger plate of FIG. 3.

With particular reference to FIGS. 3–6, a preferred embodiment of a heat transfer plate formed in accordance with the present invention is illustrated. Each heat transfer plate 42 is of a generally rectangular configuration and is preferably constructed of titanium. It is desirable that the plate be cross-sectionally dimensioned as thin as possible. A plurality of stamped corrugations 44 are provided which serve several functions in each plate. The corrugations operate to maintain the plates 42 equidistant from each other when assembled and thus provide fluid flow passageways for the heat transfer process fluids. The corrugations 44 also operate to maintain a turbulent flow path for the process fluids and thus enhance the heat transfer. Lastly, the corrugations provide rigidity to the otherwise floppy and compliant plate 42. Each plate 42 contains a first process fluid inlet 46, a first process fluid outlet 48, a second process fluid inlet 50 and a second process fluid outlet 52. Received in a depressed gasket groove 54 is a gasket 56 which is provided in the perimeter of each plate 42 to sealingly define the fluid flow chamber or passageway from the fluid inlets 46 or 50 to the fluid outlets 48 or 52. With particular reference to FIG. 5, it may be seen that gasket 56 would allow fluid flow along the face of the plate of FIG. 5 from first inlet 46 to first outlet 48 upon sealing engagement of the plate of FIG. 5 to an adjacent plate. If the face of the plate of FIG. 5 is then sealingly placed upon the face of the plate of FIG. 3 such that gasket 56 maintains the fluid sealing engagement between each plate, a fluid chamber or passageway will be provided for the first process fluid while the second process fluid may be communicated to the immediately adjacent passageway. For this purpose, gasket 56 is provided about the second inlet 50 and the second outlet 52 such that the second process fluid flowing through inlet 50 and outlet 52 may not be communicated along the face of the plate of FIG. 5 to intermix with the first process fluid. In accordance with the invention, the next gasket 56 will be rotated 180° for mounting in the next lower plate to allow flow of the second process fluid along the reverse side of the plate of FIG. 5. More particularly, and with reference to FIG. 6, a first process fluid flowing from first inlet 46 to first outlet 48 will flow along the upwardly facing plate side 58, while the flow of fluid from the second inlet 50 to the second outlet 52 will be along the reverse side of the plate, i.e. in contact with the downwardly facing plate surface 60.

Figure 4:
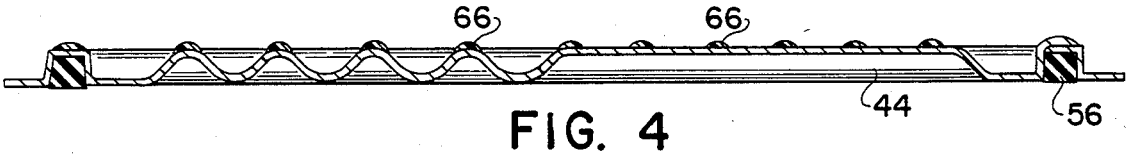
FIG. 4 is a cross-sectional view taken along line 4—4 of FIG. 3.
Figure 6:
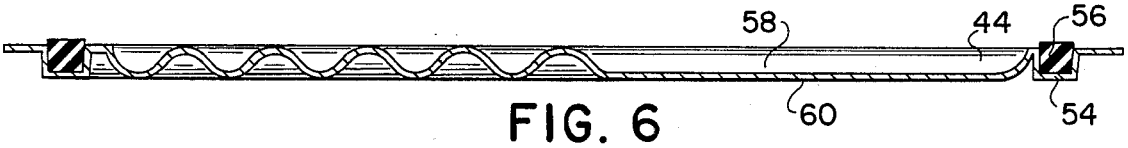
FIG. 6 is a cross-sectional view taken along line 6—6 of FIG. 5.

With reference to FIGS. 3 and 4, an insulating contact coating is applied at points of potential electrically conductive contact between heat exchanger plates to maintain an electrolytic chamber such as may be used for heat transfer to sea water in accordance with the anodic marine protection system of the aforementioned patents. The insulating contact coating 66 is only applied at points of potential electrically conductive contact to minimize the effect on heat transfer efficiency by applying a coating to the surface of the plates 42. The insulating contact coating 66 therefore only appears as a plurality of spot areas on the face of the plate of FIG. 3. This pattern develops from assembling the plates such that the chevron configurations of the corrugations 44 run in opposite directions in abutting engagement. In other words, upon assembly, each plate 42 is rotated 180° from the immediately adjacent plates. The insulating contact coating 66 is placed both on the points of abutting engagement along the corrugations 44 and over the entire perimeter areas that also abut upon assembly and which also potentially provide an electrically conductive contact.

The method of applying the insulating contact coating to each heat exchanger plate 42 comprises generally two steps. The first step is identifying points of electrically conductive contact between one plate and the immediately adjacent plate. The second step in the method comprises applying the insulating material to the points of contact whereby upon compression fitting of a plurality of the plates 42, the plates are electrically insulated to define an electrolytic chamber. The step of identifying points of electrically conductive contact comprises first taking a plate and painting it with wet paint and compressively assembling it to another plate. Upon separation of the plates, the paint will indicate the points of electrically conductive contact. A mask is then made according to the points of electrically conductive contact and may be employed for applying the insulating contact coating to all subsequent plates. The mask is constructed to include mask apertures at the points of electrically conductive contact. The step of applying the insulating contact coating is accomplished by covering a plate with the mask and then applying the coating. Upon removal of the mask, the coating will only reside at those points of mask apertures and therefore at points of abutting engagement. Numerous types of insulating materials may be applied to effect an insulating contact coating between adjacent plates. In the preferred embodiment of the invention an epoxy amide resin including alumina was employed.

With particular reference to FIG. 5, each heat exchanger plate may include electrical connectors 70 for applying a selected voltage to the plate 42. In addition, it is customary for each plate 42 to include locating slots 72, 73 for locating alignment of the plate 42 within the plate frame and assembly.

Figure 7:
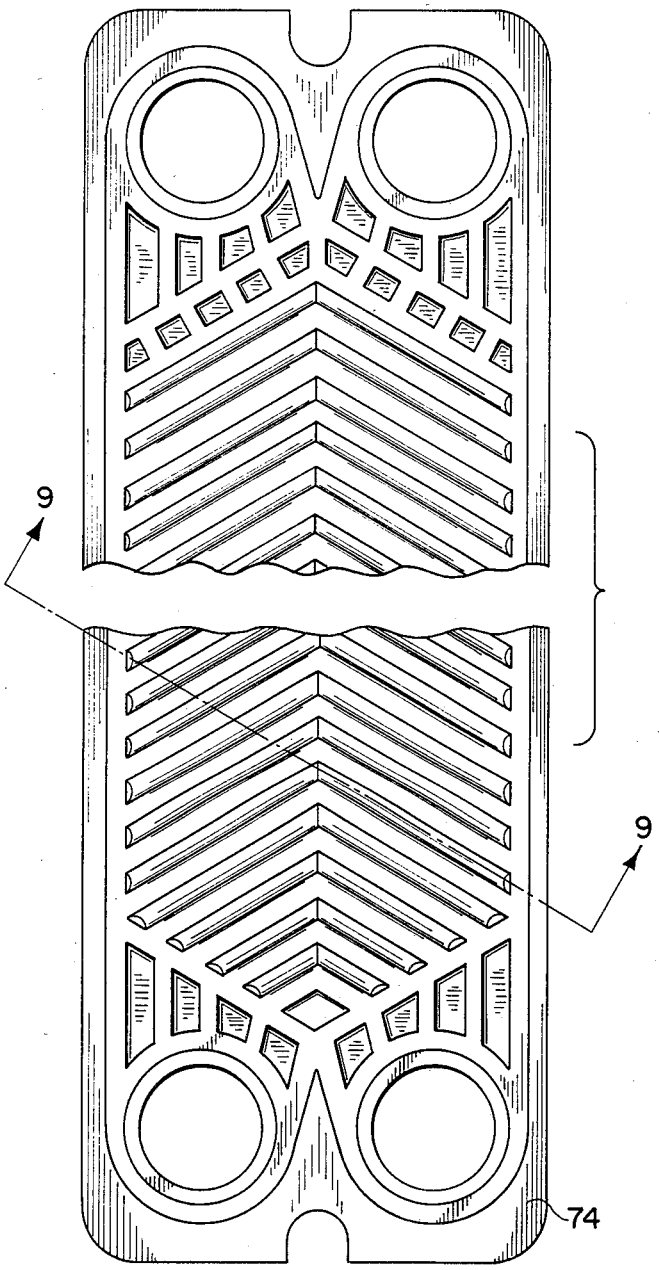
FIG. 7 is a plan view with a sectional cutout of three heat exchanger plates assembled in accordance with the present invention.
Figure 8:
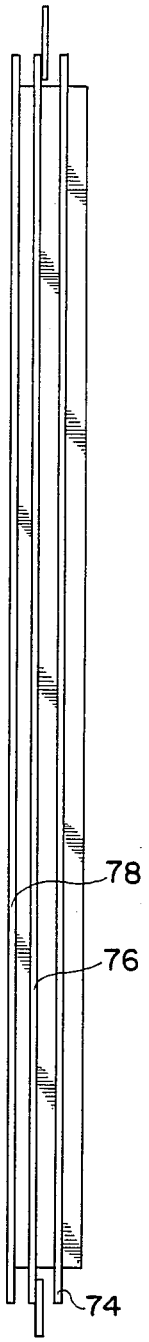
FIG. 8 is an end view of the three heat exchanger plates of FIG. 7.
Figure 9:
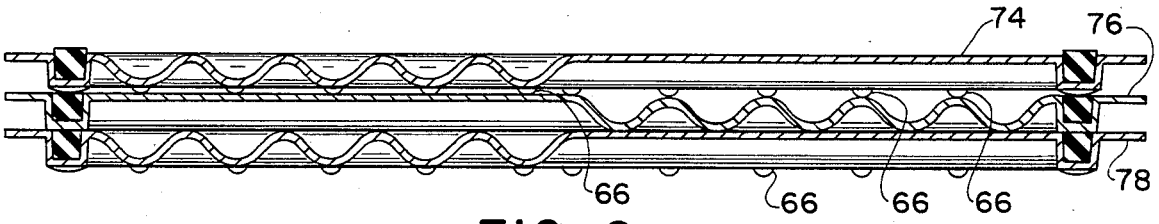
FIG. 9 is a cross-sectional view taken along line 9—9 of FIG. 7.

With particular reference to FIGS. 7–9, three heat exchanger plates constructed and assembled in accordance with the present invention are illustrated. The plates are assembled to define alternate fluid passageways for alternate communication of a first process fluid and a second process fluid.

A first plate 74 and a second plate 76 define a first fluid chamber therebetween comprising an electrolytic chamber and a fluid passageway for a potentially biofouling and scale depositing fluid such as sea water. The plates 74, 76 are non-electrically conductive to each other due to the presence of the insulating contact coating 66 at all points of abutting engagement which would normally be in electrically conductive contact.

An anodic marine protection system may be applied across the fluid passageway defined by plates 74 and 76 to maintain continuous efficient heat transfer across plates 74 and 76 despite the use of sea water as a process fluid through this chamber. An electrocatalytic coating is applied to the opposed surfaces of plates 74, 76 to catalyze oxygen evolution.

The chamber defined by plates 76 and 78 is non-electrolytic because plates 76 and 78 are in electrically conductive engagement such that the voltage charge to plate 76 is equivalent to the voltage charge of plate 78. The fluid flow passageway defined by the chamber between plates 76 and 78 therefore cannot be maintained as an electrolytic chamber. A second process fluid such as fresh water which would not normally cause biofouling or scale deposits could be advantageously employed through this fluid passageway. Plates 74 and 78 are structurally identical in that they both include electrocatalytic coatings and insulating contact coatings 66 applied at the same locations. In addition, plates 74 and 78 are aligned such that the chevron corrugations point in the same direction. Plate 76 is not structurally equivalent to plates 74 and 78 in that it lacks the electrocatalytic coating and the insulating contact coating at the points of abutting engagement to plate 78. In addition, plate 76 is rotated 180° such that the chevron corrugations thereof run in the opposite direction from the chevron corrugations of plates 74, 78.

To maintain the voltage across the electrolytic chamber defined by plates 74 and 76, a voltage must be maintained between plates 74 and 76 by electrically connecting plate 74 to a first voltage and electrically connecting plate 76 to an opposite voltage. Any conventional means may be employed for selectively applying such voltages. As plate 76 and plate 78 are in electrically conductive contact, a voltage applied to either plate 76 or 78 will operate to simultaneously charge both plates. In the preferred embodiment of the invention, a bus bar (not shown) is employed in the assembly frame to selectively apply voltage to the plates.

The invention has been described with reference to the preferred embodiment. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. A plate heat exchanger assembly having an anodic protection system comprising:

a structural frame including opposed pressure plates at opposite ends having an inlet and outlet for a first process fluid that is prone to cause fouling of heat exchange surfaces and a separate inlet and outlet for a second process fluid less prone to such fouling and means for applying compressive force between said pressure plates;

a plurality of corrugated heat exchange plates mounted on said frame between said pressure plates in close, face-to-face relationship defining a fluid passageway between each pair of adjacent corrugated plates, each such passageway being in selective communicating with the inlet and outlet for one of said two process fluids with an alternating sequence between the two;

an insulating contact coating selectively disposed only at points of potential electrically conductive contact between those adjacent plates which define a fluid passageway for said first process fluid; and means for selectively applying a voltage across those passageways carrying said first process fluid, whereby biofouling and scaling are inhibited therein.

2. The plate heat exchanger assembly as defined in claim 1 wherein said passageways carrying said first process fluid include plate surfaces having an electrocatalytic coating thereon for catalyzing oxygen evolution.

3. The plate heat exchanger assembly as defined in claim 2 wherein said insulating contact coating is coated upon said electrocatalytic coating.

4. The plate heat exchanger assembly as defined in claim 1 wherein said means for selectively applying a voltage includes means for periodically reversing the polarity.

5. The plate heat exchange assembly of claim 1, wherein said insulating contact coating comprises an epoxy resin containing alumina.

6. A plate and frame, bi-fluid heat exchanger wherein the principal heat exchange surfaces are provided by a series of thin corrugated titanium plates which are closely assembled together aligned in face-to-face relationship so as to define a fluid passageway between each plate and the next adjacent plate in said series, each of said plates having two through openings at the top end and two at the bottom end one of which at each end communicates selectively with the feed or discharge system for each of the two process fluids involved; selective gasketing between said plates so that a different one of said process fluids is handled through the fluid passageway on either side of each plate; an insulating contact coating selectively disposed only at points of potential electrically conductive contact between the corrugation ridges of adjacent, directly opposed plates in said series which define fluid passageways for a process fluid which is prone to cause fouling of heat exchange surfaces; and means for selectively applying a voltage between said directly opposed plates, whereby biofouling and scaling thereon are inhibited.

7. The plate and frame heat exchanger of claim 6, wherein the corrugations in said corrugated plates incorporate an oblique angular pattern the direction of which is reversed on the opposing faces of adjacent plates so that the potential points of electrically conductive contact are widely distributed along the upper edges of said corrugations.

8. The plate and frame heat exchanger of claim 6 or 15, wherein the inner surfaces of said directly opposed plates have an electrocatalytic surface thereon for catalyzing oxygen evolution.

9. The plate and frame heat exchanger of claim 8, wherein said means for selectively applying a voltage between said directly opposed plates includes means for periodically reversing the polarity thereof.

10. The plate and frame heat exchanger of claim 6, wherein said insulating contact coating comprises an epoxy resin containing alumina.

* * * * *